US009725814B2

(12) United States Patent
Yagi et al.

(10) Patent No.: US 9,725,814 B2
(45) Date of Patent: Aug. 8, 2017

(54) HIGH PURITY MANGANESE AND METHOD FOR PRODUCING SAME

(75) Inventors: Kazuto Yagi, Ibaraki (JP); Yuichiro Shindo, Ibaraki (JP); Eiji Hino, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 425 days.

(21) Appl. No.: 14/365,287

(22) PCT Filed: Jul. 18, 2012

(86) PCT No.: PCT/JP2012/068166

§ 371 (c)(1),
(2), (4) Date: Jun. 13, 2014

(87) PCT Pub. No.: WO2013/105291

PCT Pub. Date: Jul. 18, 2013

(65) Prior Publication Data

US 2014/0356222 A1 Dec. 4, 2014

(30) Foreign Application Priority Data

Jan. 10, 2012 (JP) ..... 2012-002323

(51) Int. Cl.
*C22C 22/00* (2006.01)
*C25C 1/10* (2006.01)
*C22B 47/00* (2006.01)

(52) U.S. Cl.
CPC ..... *C25C 1/10* (2013.01); *C22B 47/00* (2013.01); *C22C 22/00* (2013.01)

(58) Field of Classification Search
CPC ..... C22C 22/00; C25C 1/10; C22B 47/00
See application file for complete search history.

(56) References Cited

U.S. PATENT DOCUMENTS

| | | | | |
|---|---|---|---|---|
| 6,221,232 | B1 | 4/2001 | Tayama et al. | |
| 6,270,593 | B1 | 8/2001 | Shindo et al. | |
| 6,458,182 | B2 * | 10/2002 | Shindo | C22B 47/0036 148/424 |
| 7,229,510 | B2 | 6/2007 | Nakamura | |
| 7,713,364 | B2 | 5/2010 | Nakamura | |
| 8,911,611 | B2 | 12/2014 | Sanchez Recio et al. | |
| 2004/0241084 | A1 | 12/2004 | Kajiya et al. | |
| 2007/0114136 | A1 | 5/2007 | Sanchez Recio et al. | |

FOREIGN PATENT DOCUMENTS

| | | | |
|---|---|---|---|
| JP | 52-114512 | A | 9/1977 |
| JP | 53-008309 | A | 1/1978 |
| JP | 2002-167630 | A | 6/2002 |
| JP | 2002-285373 | A | 10/2002 |
| JP | 2007-119854 | A | 5/2007 |
| JP | 2009-001913 | A | 1/2009 |
| JP | 2010-209384 | A | 9/2010 |
| JP | 2010-209394 | A | 9/2010 |
| JP | 2011-068992 | A | 4/2011 |
| JP | 2011-080150 | A | 4/2011 |
| JP | 2011-094207 | A | 5/2011 |
| WO | 2011/160578 | A1 | 12/2011 |

OTHER PUBLICATIONS

Machine translation of JP 2007-119854 (Japanese language document published May 17, 2007).*

* cited by examiner

*Primary Examiner* — Jonathan Johnson
*Assistant Examiner* — Christopher Kessler
(74) *Attorney, Agent, or Firm* — Howson & Howson, LLP

(57) ABSTRACT

High purity manganese having a purity of 3N (99.9%) or more, wherein number of non-metal inclusions with a size of 0.5 μm or more is 50000 or less per 1 g of the high purity manganese. A method for producing high purity manganese, wherein refining is performed using a raw material (secondary raw material) obtained by acid-washing a manganese raw material (primary raw material) so that the produced high purity manganese has a purity of 3N (99.9%) or more, and number of non-metal inclusions with a size of 0.5 μm or more is 50000 or less per 1 g of the high purity manganese. The present invention provides a method for producing high purity metal manganese from commercially available manganese, and aims to obtain high purity metal manganese having a low LPC.

8 Claims, No Drawings

HIGH PURITY MANGANESE AND METHOD FOR PRODUCING SAME

BACKGROUND

The present invention relates to high purity manganese obtained from commercially available electrolytic manganese, and a method for producing the same.

The method of producing commercially available metal manganese is the electrolytic method in which metal manganese is obtained from an ammonium sulfate electrolytic bath, and the commercially available electrolytic manganese obtained with the foregoing method contains roughly several 100 to several 1000 ppm of S and oxygen, which are the cause of non-metal inclusions.

As the method of eliminating S and O from the electrolytic manganese, the sublimation refining method is well known in conventional technologies. Nevertheless, the sublimation refining method has drawbacks of requiring an extremely expensive device, and the production yield being extremely inferior. Moreover, while S and O can be reduced with the sublimation refining method, since there will be contamination from the heater material, capacitor material and other materials of the sublimation refining device, there is a problem in that the metal manganese obtained with the refining method is not suitable as a raw material for electronic devices.

As conventional technologies, Patent Document 1 below describes a method for eliminating sulfur in metal manganese. Specifically, Patent Document 1 describes adding, for example, manganese carbonate which will become a manganese oxide at the melting temperature of a manganese acid compound such as MnO, $Mn_3O_4$ and $MnO_2$, and/or metal manganese, melting the metal manganese, to which the manganese compound was added, in an inert atmosphere, and holding the product preferably for 30 to 60 minutes in a molten state so as to attain a sulfur content of 0.002%. Nevertheless, Patent Document 1 fails to specifically describe the existence form and abundance of non-metal inclusions.

Patent Document 2 below describes an electrowinning method of metal manganese, and specifically describes an electrowinning method of metal manganese in which used is an electrolytic solution prepared by adding an oxidizing agent to a solution obtained by excessively dissolving high purity metal manganese in hydrochloric acid and filtering non-dissolved substances, subjecting the obtained solution to neutralization, filtering the produced precipitate, and adding a buffer agent. Patent Document 2 further describes an electrowinning method of metal manganese in which used is an electrolytic solution preferably prepared by further adding metal manganese to the hydrochloric acid solution of metal manganese, adding hydrogen peroxide and ammonia water to a solution obtained by filtering non-dissolved substances, filtering the precipitate produced under mildly acidic or neutral pH, and adding a buffer agent. Patent Document 2, however, fails to specifically describe the existence form and abundance of non-metal inclusions.

Patent Document 3 below describes a method for producing high purity manganese. Specifically, Patent Document 3 describes a method of high purification in which the ion exchange refining method of using chelate resin in the manganese chloride aqueous solution is adopted, and subsequently electrowinning from the refined manganese chloride aqueous solution is performed. Patent Document 3 further describes that, in a dry method, high purity manganese can be obtained from the solid phase manganese via vacuum sublimation refining method (method of selectively condensing and vapor-depositing, at the cooling part, the manganese vapor obtained from the sublimation of the solid phase manganese based on a vapor pressure differential). Patent Document 3, however, fails to specifically describe the existence form and abundance of non-metal inclusions.

Patent Document 4 below describes a method for producing a low oxygen Mn material, and further describes that a Mn material, in which the oxygen content is reduced to 100 ppm or less, can be obtained by subjecting a Mn raw material to induction skull melting in an inert gas atmosphere, and that the acid washing of the Mn raw material prior to the induction skull melting is preferable for seeking the further reduction of oxygen. Nevertheless, Patent Document 4 fails to specifically describe the existence form and abundance of non-metal inclusions.

Patent Document 5 below describes a Mn alloy material for a magnetic material, a Mn alloy sputtering target and a magnetic thin film, and further describes that the oxygen content is 500 ppm or less, S content is 100 ppm or less, and preferably the total content of impurities (elements other than Mn and alloy components) is 1000 ppm or less.

Patent Document 5 further describes that Ca, Mg, La or the like is added as a deoxidizing agent to commercially available electrolytic Mn and high frequency melting is performed in order to eliminate oxygen and sulfur, and that vacuum distillation is further performed after preliminarily melting the electrolytic Mn. Nevertheless, Patent Document 5 fails to specifically describe the existence form and abundance of non-metal inclusions.

Patent Document 6 below describes a method for producing a high purity Mn material and a high purity Mn material for forming a thin film. In the foregoing case, Patent Document 6 describes that coarse Mn is preliminarily melted at 1250 to 1500° C., and, by subsequently performing vacuum distillation at 1100 to 1500° C., a high purity Mn material is obtained. Preferably, the degree of vacuum for the vacuum distillation is set to $5\times10^{-5}$ to 10 Torr. Patent Document 6 describes that the high purity Mn obtained thereby has a total impurity content of 100 ppm or less, oxygen content of 200 ppm or less, nitrogen content of 50 ppm or less, S content of 50 ppm or less, and C content of 100 ppm or less. Nevertheless, Patent Document 6 fails to specifically describe the existence form and abundance of non-metal inclusions.

Furthermore, Patent Document 7 below describes a sputtering target made from a high purity Mn alloy, Patent Document 8 describes a method for recovering manganese through use of sulfuric acid, and Patent Document 9 describes a method for producing metal manganese by heating and reducing manganese oxide, but none of these Documents specifically describe the existence form and abundance of non-metal inclusions.

Patent Document 1: JP-A-553-8309
Patent Document 2: JP-A-2007-119854
Patent Document 3: JP-A-2002-285373
Patent Document 4: JP-A-2002-167630
Patent Document 5: JP-A-H11-100631
Patent Document 6: JP-A-H11-152528
Patent Document 7: JP-A-2011-068992
Patent Document 8: JP-A-2010-209384
Patent Document 9: JP-A-2011-094207

SUMMARY OF INVENTION

An object of this invention is to obtain high purity manganese from commercially available electrolytic manganese and provide a method for producing the same, and in particular to obtain high purity manganese having a low content of non-metal inclusions.

The present invention can achieve the foregoing object by providing the following invention.

1) High purity manganese having a purity of 3N (99.9%) or more, wherein number of foreign substances, which are non-metal inclusions with a size of 0.5 μm or more, is 50000 or less per 1 g of the high purity manganese.

2) The high purity manganese according to 1) above, wherein number of foreign substances, which are non-metal inclusions with a size of 0.5 μm or more, is 10000 or less per 1 g of the high purity manganese.

The present invention additionally provides the following invention.

3) A method for producing high purity manganese, wherein refining is performed using a raw material (secondary raw material) obtained by acid-washing a manganese raw material (primary raw material) so that the produced high purity manganese has a purity of 3N (99.9%) or more, and number of foreign substances, which are non-metal inclusions with a size of 0.5 μm or more, is 50000 or less per 1 g of the high purity manganese.

4) The method for producing high purity manganese according to 3) above, wherein the manganese raw material (primary raw material) is acid-washed and thereafter leached so that 1% or more of raw material manganese remains in a solution, and electrolysis is performed using a leachate thereof to obtain manganese having a purity of 3N or more.

5) The method for producing high purity manganese according to 4) above, wherein the manganese raw material is leached so that 1 to 50% of raw material manganese remains in the solution.

6) The method for producing high purity manganese according to any one of 3) to 5) above, wherein the electrolytic manganese is melted under mildly reduced pressure in an inert atmosphere.

According to the present invention, it is possible to achieve the following effects.

(1) By reducing impurities that became precipitated beyond the solubility, it is possible to obtain high purity metal manganese with few non-metal inclusions; that is, number of foreign substances with a size of 0.5 μm or more; is 50000 or less per 1 g of the high purity manganese.

(2) High purity manganese can be produced with a general-purpose furnace without using a special device, and high purity manganese can be obtained at a lower cost and higher yield in comparison to the conventional distillation method.

DETAILED DESCRIPTION

Embodiments of the present invention are now explained in detail.

With the method for producing high purity manganese according to the present invention, it was discovered that a commercially available manganese raw material having a purity of 2N level has numerous impurities and foreign substances deposited thereon, and the acid washing of the surface of the manganese raw material is effective for reducing impurities and non-metal inclusions. Any method may be used so as long as it is possible to eliminate the surface deposits and oxidized surface layer on the raw material manganese. As the acid, used may be nitric acid, sulfuric acid, hydrochloric acid or a mixed acid thereof.

Moreover, with the method for producing high purity manganese according to the present invention, since MnS, MnO, MnC and foreign substances (non-metal inclusions such as $SiO_2$) remain on the surface of a commercially available manganese raw material having a purity level of 2N, the manganese raw material is acid-washed to eliminate these impurities. While the manganese raw material is subsequently dissolved in acid, the dissolution is performed so that 1 to 50% of raw material manganese will remain, and more preferably so that 10 to 30% of raw material manganese will remain.

When raw material manganese is caused to remain in the solution as described above, the productivity will deteriorate by that much and, therefore, is not normally implemented (not noticed). Nevertheless, it was discovered that, by causing raw material manganese to remain in the solution as described above, it is possible to effectively reduce foreign substances, which are non-metal inclusions with a size of 0.5 μm or more.

The reason for this has been discovered to be a phenomenon where the impurities, which are nobler than the manganese in the solution, are adsorbed to the remaining manganese and eliminated. Moreover, the remaining manganese functions as a filter, and eliminates the foreign substances. When the remaining manganese is less than 1%, the foregoing refining effect is not yielded. In the foregoing case, metal manganese may be newly added. Similarly effects can thereby be exhibited.

Since the productivity will not be considerably affected so as long as the remaining raw material manganese is 50% or less, the preferred range of the remaining raw material manganese is 1 to 50%. The productivity is considerably affected if the remaining raw material manganese exceeds 50%.

Nevertheless, the present invention does not deny causing the manganese content to remain beyond 50%, and such residual amount of manganese may be adopted as needed. The greater the residual amount of manganese, the higher the refining effect.

High purity manganese is obtained from this solution via electrolysis. In addition, it is possible to produce high purity Mn by melting the manganese under reduced pressure in an inert atmosphere and eliminating impurities as slag. The expression "under mildly reduced pressure in an inert atmosphere" refers to an atmosphere of argon, helium or the like having a level of 0.01 to 750 torr. It is more effective to add La, Ca, Mg or the like to the melting manganese as a deoxidizing agent, which has stronger deoxidizing activity than Mn. With this melting and succeeding casting, impurities are condensed into a top part of the cast ingot to form slag, which can be removed from the ingot.

A commercially available Mn raw material is acid-washed and the manganese is acid-leached as described above. By performing electrolysis using the resultant leachate as an electrolytic solution and melting the resultant cathode-deposited manganese, it is possible to produce manganese having a purity of 4N (99.99%) or more.

Moreover, based on the foregoing processes, it is possible to cause the number of foreign substances, which are non-metal inclusions with a size of 0.5 μm or more, to be 50000 or less per 1 g of the high purity manganese. Note that these non-metal inclusions can be measured as an insoluble residual particle count (LPC).

In other words, it is possible to produce manganese in which the number of foreign substances with a size of 0.5 μm or more is 50000 or less per 1 g of the high purity manganese based on the insoluble residual particle count (LPC), and further possible to produce manganese in which the number of foreign substances (non-metal inclusions)

with a size of 0.5 μm or more is 10000 or less per 1 g of the high purity manganese based on the insoluble residual particle count (LPC).

The insoluble residual particle count (LPC) is a parameter that is valued as one of the methods for evaluating the metal raw material for electronic devices, and refers to the insoluble residual particle count that is detected upon dissolving metal in acid, and extremely favorable correlation is acknowledged between such LPC value and electronic material quality; specifically, between such LPC value and the defect ratio of sputter deposition, including the generation of particles upon sputtering a sputtering target.

Note that the insoluble residual particle count is abbreviated as "LPC" because a Liquid Particle Counter (LPC) is used for measuring the insoluble residual particle count (LPC).

To specifically explain this measurement method, 5 g of a sample is collected, slowly dissolved in 200 cc of acid so that the inclusions do not dissolve therein, and further diluted with ultrapure water up to 500 cc, and 10 cc is extracted therefrom to measure with the Liquid Particle Counter. For example, if the number of inclusions is 1000 inclusions/cc, since 0.1 g of the sample is measured in 10 cc, the number of inclusions will be 10000 inclusions/g.

EXAMPLES

The present invention is now explained with reference to the following Examples and Comparative Examples. However, these Examples and Comparative Examples are described for facilitating the understanding of the invention, and the present invention shall not be limited to these Examples or Comparative Examples.

Example 1

Commercially available manganese having a purity of 2N (99%) was used as the starting raw material.

The manganese raw material was washed in a nitric acid solution. In addition, while the manganese is leached in hydrochloric acid, such leaching was performed by causing 1% of the raw material manganese (metal) to remain in the solution. Electrolysis was performed by placing this solution on the cathode side. When the manganese obtained from the foregoing electrolysis was melted at 1300° C. at 500 torr in an Ar atmosphere, the yield of the normal part was 73%.

Subsequently, 5 g of Mn was dissolved in hydrochloric acid, diluted with ultrapure water up to 500 cc, and 10 cc was extracted therefrom and measured. Consequently, the number of non-metal inclusions (foreign substances) per 1 g of the manganese was 49800. The purity level was 3N.

Example 2

Manganese (primary raw material) having a purity of 2N (99%) was used as the starting raw material.

The manganese raw material was washed in a sulfuric acid solution. In addition, while the manganese is leached in hydrochloric acid, such leaching was performed by causing 50% of the raw material manganese (metal) to remain in the solution.

Electrolysis was performed by placing this solution on the cathode side, Subsequently, the obtained manganese was melted at 1280° C. under a reduced pressure of 1 torr in an Ar gas atmosphere. Consequently, slag was condensed at the upper part of the ingot.

The yield of the normal part was 82%. Consequently, the number of non-metal inclusions (foreign substances) per 1 g of the manganese was 9500. The purity level was 4N.

Example 3

The 3N manganese obtained in Example 1 was used as the starting raw material, this was used as the anode to perform electrolysis in a hydrochloric acid solution, and electrolytic Mn having a purity level of 4N was thereby produced.

In addition, since foreign substances still remained on the electrodeposited surface, the electrodeposited surface was washed in diluted nitric acid to eliminate impurities and the like, and the manganese was thereafter melted at 10 torr in an Ar atmosphere with a molten metal holding time of 30 minutes. Based on this melting, it was possible to eliminate the slag portion formed at the upper part of the ingot, and obtain high purity Mn of 5N (99.999%).

This product was able to satisfy the conditions of the present invention. Consequently, the number of non-metal inclusions (foreign substances) per 1 g of the manganese was 5900.

Example 4

Commercially available manganese (primary raw material) having a purity of 2N (99%) was used as the starting raw material. The manganese raw material was washed in a diluted sulfuric acid solution.

Subsequently, the manganese raw material was acid-leached so as to cause approximately 20% of raw material manganese (metal) to remain in the solution. Subsequently, electrolysis was performed using a sulfuric acid solution as the solution of the anode, and the acid-leached solution as the solution of the cathode. The electrolytic manganese was melted at 1280° C. under a reduced pressure of 20 torr in an Ar gas atmosphere. Here, Mg was added in order to efficiently extract oxygen. Consequently, slag was condensed at the upper part of the ingot.

The yield of the normal part was 82%. Consequently, the number of non-metal inclusions (foreign substances) per 1 g of the manganese was 5300. The purity level was 3N.

The Comparative Examples are now explained.

Comparative Example 1

The raw material was the same as Example 1, and the commercially available manganese was directly melted at 1300° C. under mildly reduced pressure of several torr. Consequently, a large amount of slag was generated, and the yield was 38%. The LPC of the produced manganese was 121000, and extremely high. The purity level was 2N.

Comparative Example 2

The raw material was the same as Example 1, and the entire amount of manganese was leached in a sulfuric acid solution without acid-washing the manganese. The solution was electrolyzed to obtain electrolytic manganese. The manganese was directly melted at 1300° C. under mildly reduced pressure of approximately 10 torr. Consequently, a large amount of slag was generated, and the yield was 51%. The LPC of the produced manganese was 52100, and extremely high. The purity level was 2N5.

According to the present invention, it is possible to achieve the following effects.

(1) At the stage of the raw material, it is possible to obtain high purity metal manganese with few non-metal inclusions; that is, number of foreign substances with a size of 0.5 μm or more is 50000 or less per 1 g of the high purity manganese (number of foreign substances with a size of 0.5 μm or more, as the insoluble residual particle count (LPC), is 50000 or less per 1 g of the high purity manganese).

(2) High purity manganese can be produced with a general-purpose furnace without using a special device, and high purity manganese can be obtained at a lower cost and higher yield in comparison to the conventional distillation method.

Since the significant effects described in (1) and (2) can be obtained, the present invention is useful as: metal manganese for use as a wiring material, an electronic component material of a magnetic material (magnetic head) or the like, and a semiconductor component material; and a metal manganese thin film, and is particularly useful as high purity manganese for use as a sputtering target material for forming a manganese-containing thin film.

The invention claimed is:

1. A method for producing a high purity manganese, comprising a refining process performed by the steps of:

acid-washing a manganese primary raw material having a purity of 2N or higher to remove contaminants and a layer of oxides from a surface thereof to obtain a secondary raw material;

leaching manganese with an acid from the secondary raw material to produce an acid leachate such that an amount of 1% or more of the secondary raw material remains undissolved within the acid leachate after said leaching step;

performing electrolysis using the acid leachate as an electrolytic solution on a cathode side of the electrolysis to obtain a manganese deposit; and melting the manganese deposit in an inert atmosphere of a reduced pressure of 0.01 to 750 torr to eliminate impurities as slag and to obtain a cast ingot of high purity manganese having a purity of 3N (99.9%) or higher and containing a dispersion of foreign substances of non-metal inclusions with a size of 0.5 μm or larger in a number of 50000 or less per 1 g of the high purity manganese.

2. The method according to claim 1, wherein, during said melting step, a deoxidizing agent having a stronger active potency than Mn is added to the manganese deposit and wherein the slag is concentrated on an upper part of the ingot.

3. The method according to claim 2, wherein the deoxidizing agent is La, Ca or Mg.

4. The method according to claim 1, further comprising the step of washing the manganese deposit with diluted nitric acid.

5. The method for producing high purity manganese according to claim 1, wherein the amount of the secondary raw material remaining undissolved in the acid leachate is 1 to 50%.

6. The method according to claim 5, wherein, during said melting step, a deoxidizing agent having a stronger active potency than Mn is added to the manganese deposit and wherein the slag is concentrated on an upper part of the ingot.

7. The method according to claim 6, wherein the deoxidizing agent is La, Ca or Mg.

8. The method according to claim 6, further comprising the step of washing the manganese deposit with diluted nitric acid.

* * * * *